United States Patent [19]

Sakaguchi

[11] Patent Number: 4,626,495

[45] Date of Patent: Dec. 2, 1986

[54] PHOTOGRAPHIC IMAGE RECEIVING ELEMENTS FOR SILVER SALT DIFFUSION TRANSFER PROCESSES

[75] Inventor: Shinji Sakaguchi, Kanagawa, Japan

[73] Assignee: Fuji Photo Film Co., Ltd., Kanagawa, Japan

[21] Appl. No.: 642,324

[22] Filed: Aug. 20, 1984

[30] Foreign Application Priority Data

Aug. 19, 1983 [JP] Japan ..... 58-151355

[51] Int. Cl.[4] ..... G03C 5/54

[52] U.S. Cl. ..... 430/232; 430/231; 430/233

[58] Field of Search ..... 430/231, 232, 233

[56] References Cited

U.S. PATENT DOCUMENTS

| | | | |
|---|---|---|---|
| 3,607,269 | 9/1971 | Young | 430/232 |
| 3,873,317 | 3/1975 | Kato et al. | 430/232 |
| 4,520,096 | 5/1985 | Endo et al. | 430/233 |

*Primary Examiner*—Richard L. Schilling
*Attorney, Agent, or Firm*—Sughrue, Mion, Zinn, Macpeak & Seas

[57] ABSTRACT

A photographic image receiving element for a silver salt diffusion transfer process which comprises a hydrolyzable first alkali impermeable polymer layer applied on a base and an image receiving layer thereon comprising a hydrolyzable second alkali impermeable polymer layer containing silver precipitation nuclei which is prepared by hydrolyzing at least a part of the hydrolyzable second alkali impermeable polymer layer so as to be alkali permeable, the improvement wherein at least one hydrophilic copolymer layer containing at least one of gum arabic and arabic acid is coated between said first alkali impermeable polymer layer and said image receiving layer, and said first alkali impermeable polymer layer contains at least one compound represented by formula (I) or formula (II)

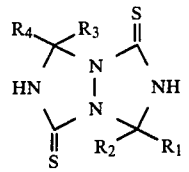

(I)

wherein $R_1$, $R_2$, $R_3$ and $R_4$ each represents a hydrogen atom, an alkyl group having from 1 to 8 carbon atoms, or an aryl group having from 6 to 12 carbon atoms,

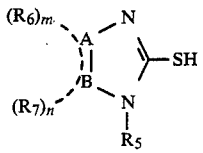

(II)

wherein A and B each represents a nitrogen atom or a carbon atom, provided that A and B are not both nitrogen atoms, m is 0 when A is a nitrogen atom, n is 0 when B is a nitrogen atom, and m and n are 1 when A and B are each a carbon atom, $R_5$, $R_6$ and $R_7$ each represents a hydrogen atom, an alkyl group having from 1 to 10 carbon atoms or a substituted or nonsubstituted aryl group having from 6 to 20 carbon atoms, and $R_6$ and $R_7$ together can additionally represent a substituted or nonsubstituted aromatic carbocyclic ring (preferably 6-membered) together with A and B.

15 Claims, No Drawings

PHOTOGRAPHIC IMAGE RECEIVING ELEMENTS FOR SILVER SALT DIFFUSION TRANSFER PROCESSES

FIELD OF THE INVENTION

The present invention relates to image receiving elements used for diffusion transfer photography, and more particularly to image receiving elements wherein silver precipitation nuclei are finely dispersed in a matrix material capable of permeating alkali processing compositions, to provide image receiving elements used for diffusion transfer processes which have improved storage stability.

BACKGROUND OF THE INVENTION

Diffusion transfer photographic processes utilizing silver salts, such as silver halides, etc., are well known to persons skilled in the art. In such photographic processes, a light-sensitive layer of a photographic light-sensitive elements which is prepared by dispersing fine grains of a light-sensitive silver salt such as silver halide in a hydrophilic binder such as gelatin, polyvinyl alcohol, carboxymethyl cellulose, polyvinylpyrrolidone, methyl cellulose, etc., and applying the dispersion to a base such as paper, baryta paper or a base of a high polymer such as polyethylene terephthalate, cellulose diacetate, cellulose triacetate, cellulose nitrate, polycarbonate, polyvinyl chloride, etc., is imagewise exposed to light as a function of incident electromagnetic light rays, and developed by bringing it into contact with a processing solution containing a developer. In such case, exposed silver halide in the light-sensitive layer is reduced (developed) to form nondiffusible silver. At about the same time or thereafter, the light-sensitive element is brought into contact with a water soluble silver complex salt forming agent, by which unexposed silver halide reacts with the water soluble silver complex salt forming agent to form a water soluble silver complex compound. At this time, if an image receiving element having a layer (i.e., an image receiving layer) wherein a substance which becomes a catalyst for a reduction reaction of the above described water soluble silver complex compound (silver precipitation nuclei which are so-called nuclei of physical development) is dispersed in a hydrophilic binder and is allowed to contact the above described light-sensitive layer, the silver complex compound formed in the light-sensitive layer diffuses by means of the processing solution from the light-sensitive layer into the image receiving layer, where it is reduced to form silver by the function of the nuclei of development. That is, silver images are formed on the image receiving face as if the images were transferred from the light-sensitive layer to the image receiving layer. Therefore, the above described photographic process is called the silver salt diffusion transfer photographic process.

Image receiving elements for the diffusion transfer photographic process which contain a silver precipitant in a matrix material capable of permeating alkali processing compositions have been known and described, for example, in British Pat. No. 1,149,921.

In the technical field of silver salt diffusion transfer photography, various studies concerning image receiving elements used for such photography have been hitherto conducted. For example, metal sulfides, metal selenides, and heavy metal or noble metal colloids of low solubility in water are generally used as silver precipitation nuclei and it is desirable that these silver precipitation nuclei for the image receiving elements have high activity. For example, U.S. Pat. No. 2,698,237 has described a process for obtaining silver precipitation nuclei having high activity which comprises blending a water soluble metal salt with a water soluble sulfide in fine silica to form a precipitate of water insoluble metal sulfide. Further, Japanese Patent Publication No. 32754/69 has described image receiving elements which are prepared by a process comprising incorporating a silver precipitation nucleus substance in an alkali impermeable polymer by a vacuum evaporation process, dissolving said polymer in a solvent, applying the resulting solution to a base, drying it, and thereafter subjecting the surface layer of the polymer layer to chemical processing such as hydrolysis, etc., so as to be alkali permeable.

Further, Japanese Patent Application (OPI) No. 73150/73 (The term "OPI" as used herein refers to a "published unexamined Japanese Patent Application") has disclosed image receiving elements for the silver salt transfer process which are prepared by hydrolyzing a cellulose ester layer and incorporating silver precipitation nuclei in the hydrolyzed layer simultaneously with or after hydrolysis. However, there is a problem in that silver images formed on resulting image receiving elements easily discolor or fade during preservation.

As a way of overcoming this problem, Japanese Patent Publication No. 5392/71, U.S. Pat. No. 3,533,789 and British Pat. No. 1,164,642 have disclosed a process which comprises applying a solution of a water soluble polymer containing an alkali neutralizing component to the surface of the obtained silver images. However, in this process, a long period of time is required for completely drying the surface to which an aqueous solution of the polymer is applied, and the prints can not be placed on top of one another because the surface is soft and sticky, and fingerprints and dust often adhere to the surface. In addition, application of such a solution to the silver images is troublesome.

Japanese Patent Publication No. 44418/81, corresponding to U.S. Pat. No. 3,607,269, has disclosed image receiving materials for a silver salt diffusion transfer process which comprises a base, a cellulose ester, polyvinyl ester, or polyvinyl acetate layer I containing a diffusible chemical suitable for modifying the photographic characteristics of silver transfer images, which is hydrolyzable and becomes alkali permeable by hydrolysis, provided on the base, and a regenerated cellulose layer II containing silver precipitation nuclei provided on said layer I, wherein the layer I does not contain silver precipitation nuclei and the layer II does not contain the above described diffusible chemical. As the diffusible chemical, organic mercapto compounds have been described.

According to the above described Japanese Patent Publication No. 44418/81, at column 2, lines 25–37, it has been described that the above described diffusible chemical is placed below the image forming layer prior to carrying out diffusion transfer processing, and a toning agent and a stabilizer are released from the lower layer by extraction during the diffusion transfer processing, and, consequently, the effect by the chemical is enhanced during the diffusion transfer processing at column 2, lines 25–37. Further in the above described Japanese Patent Publication, at column 6, line 44 to column 7, line 19, it has been described that these layers I and II are not independent or separated layers, but are formed as a single continuous layer wherein a part in the depth direction is modified, and that, in case of producing these layers by a plurality of continuous applications, a common solvent is used to form a single continuous layer without forming interfaces between layers. Accordingly, this process is understood as a characteristic technique for obtaining the above described effect. According to this process, the toning agent is at least present in the layer II in the very initial stage of development and it diffuses from the layer I into the layer II during development to act as a toning agent. As is well known to persons skilled in the art, the toning agent has a function of changing color of images, which acts in the process of forming development silver to provide an influence upon the surface state of the formed development silver or other optical characteristics. Accordingly, it is naturally ineffective if it does not diffuse from the lower layer during formation of development silver to act with it.

However, the process described in Japanese Patent Publication No. 44418/81 involves certain problems in practice, and it is difficult to realize as a practical process. Firstly, in the process for producing the image receiving materials, if the diffusible chemical is incorporated in only layer I, layer I is swollen by the solvent for the layer II in case of applying the layer II and the diffusible chemical contained in the layer I diffuses into the layer II and it is nearly uniformly redistributed in the layer I and the layer II, because exemplified mercapto substituted compounds such as 1-phenyl-5-mercaptotetrazole or imidazolidine-thione, etc., are very soluble in the organic solvent used for containing. Secondly, although the diffusible chemical in layer II is removed by dissolving in a hydrolyzing solution by the hydrolysis processing, the diffusible chemical tends to diffuse from layer I into layer II before the image receiving materials produced can be used photographically by a user, whereby the photographic performance deteriorate. Further, if the amount of the chemical added to layer I is reduced in order to avoid such problems satisfactory modification of photographic characteristics of transfer images is not obtained. Since layer I and layer II are composed of very analogous components such that an interface is not formed, and, particularly since mutual diffusion of substances between layers I and II easily occurs, the abovedescribed problems are very difficult to avoid.

SUMMARY OF THE INVENTION

As a result of extensive studies, it has now been found that the above described problems can be overcome by providing a photographic image receiving element for a silver salt diffusion transfer process which comprises a hydrolyzable first alkali impermeable polymer layer applied on a base and an image receiving layer thereon comprising a hydrolyzable second alkali impermeable polymer layer containing silver precipitation nuclei which is prepared by hydrolyzing at least a part of the hydrolyzable second alkali impermeable polymer layer so as to be alkali permeable, wherein at least one hydrophilic polymer layer containing at least one of gum arabic and arabic acid is placed between said first alkali impermeable polymer layer and said image receiving layer, and said first alkali impermeable polymer layer contains at least one compound represented by formula (I) or formula (II)

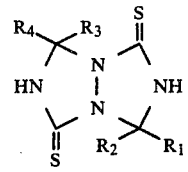

(I)

wherein $R_1$, $R_2$, $R_3$ and $R_4$ each represents a hydrogen atom, an alkyl group having from 1 to 8 carbon atoms, or an aryl group having from 6 to 12 carbon atoms, which is substituted or unsubstituted,

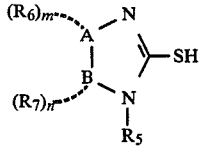

(II)

wherein A and B each represents a nitrogen atom or a carbon atom, provided that A and B are not nitrogen atoms, m is 0 when A is a nitrogen atom, n is 0 when B is a nitrogen atom, and m and n are 1 when A and B are each a carbon atom, $R_5$, $R_6$ and $R_7$ each represents a hydrogen atom, an alkyl group having from 1 to 10 carbon atoms or a substituted or nonsubstituted aryl group having from 6 to 20 carbon atoms, and $R_6$ and $R_7$ together can additionally represent a substituted or nonsubstituted aromatic carbocyclic ring (preferably 6-membered) together with A and B.

DETAILED DESCRIPTION OF THE INVENTION

Of the compounds represented by formula (II), those wherein $R_5$ is an alkyl group or an aryl group are preferred.

Examples of compounds represented by formulae (I) and (II) include the following: 2-imidazolidinethione, 1-ethyl-2-imidazolidinethione, 1-3'-methylphenyl-2-imidazolidinethione, 2-mercaptoimidazole, 3-mercapto-4H-1,2,4-triazole, 4-phenyl-3-mercapto-4H-1,2,4-triazole, 5-propyl-2-mercaptobenzimidazole, 5-phenyl-2-mercaptobenzimidazole, 5-nitro-2-mercaptobenzimidazole, 2-mercaptobenzimidazole, 1-phenyl-2-mercaptoimidazole, 1-(4-N-butylcarbamoylphenyl)-2-mercaptoimidazole, 2-mercapto-4-phenylimidazole, 1-benzyl-2-mercaptoimidazole, 1-(4-N-hexylcarbamoylphenyl)-2-mercaptoimidazole, 1,4-dimercapto-3H,6H-2,3a,5,6a-tetrazapentalene, and 3,6-diphenyl-1,4-dimercapto-3H,6H-2,3a,5,6a-tetrazapentalene.

Organic mercapto compounds in the present invention, there are mercapto compounds which dissociate or decompose under an alkaline condition (precursors) and metal salts of organic mercapto compounds.

Examples of the mercapto compound precursors include 2-morpholinomethyl-4-phenyl-1,2,4-triazole-3-thione, 2-phenyl-4-hydroxymethyl-1,2,4-triazole-3-thione, 2-acetylthioimidazole, 5-ethoxycarbonylthio-3-methyl-4-phenyl-1,2,4-triazole, etc.

As metal salts of organic mercapto compounds, salts and complex compounds of the above described mercapto compounds and various metal ions can be used. Examples of such metal ions include ions of gold, lead, platinum, cadmium, zinc, iron, cobalt, sodium, potassium, calcium, lithium, barium, etc.

Of these compounds, mercaptobenzimidazoles, mercaptoimidazoles, and tetrazapentalenes are preferred and mercaptoimidazoles are particularly preferred from the viewpoints of image stability (after image formation) and prevention of changes with the passage of time during storage before image processing.

An important feature of the present invention is that a layer containing gum arabic and/or arabic acid is used as a hydrophilic polymer layer between the first alkali impermeable polymer layer and the image receiving layer, and further, an alkali impermeable layer containing at least one compound represented by formula (I) or formula (II) is used as the first alkali impermeable polymer layer, whereby the images after processing are remarkably stabilized.

The hydrophilic polymer layer used in the present invention is preferred to be hardened in view of the process of producing the photographic image receiving element of for the purpose of securing water resistance of the photographic image receiving element and adhesion to the adjacent layer.

Useful hardeners are well known to persons skilled in the art, and those described, e.g., in *Product Licensing Index,* Vol. 92, (1971), page 108, paragraph entitled "Hardeners" can be suitably used. Particularly, aldehyde type hardeners (for example, formalin, glyoxal, glutaraldehyde and dialdehyde starch, etc.) and N-methylol (or alkoxymethyl) type hardeners (for example, dimethylolurea, trimethylol melamine, hexamethylolmelamine, hexamethoxymethylmelamine, poly-N-methylolacrylamide and poly-N-methoxymethylacrylamide, etc.) are preferred.

Hydrophilic polymers used in the present invention are polymers which substantially dissolve in water in an amount of 1% (by weight) or more, based on the weight of the water.

The hydrophilic polymer layer is composed substantially of gum arabic and/or arabic acid, and it may contain less than 30% (by weight), and preferably less than 20% (by weight) of other hydrophilic polymers. In the present invention, the term: arabic acid means arabic acid and salts thereof (for example, calcium salt and magnesium salt).

Examples of other hydrophilic polymers that may be used include natural polysaccharides and derivatives thereof, natural proteins and derivatives thereof, and synthetic hydrophilic polymers. More specifically, examples of natural polysaccharides and derivatives thereof include guar gum, Locust bean gum, carrageenan, pectin, algin (alginic acid and sodium alginate, etc.), cellulose derivatives (carboxymethyl cellulose), cellulose sulfates (sodium salt, potassium salt and quaternary ammonium salt, etc.), methyl cellulose, hydroxyethyl cellulose, hydroxypropyl cellulose, hydroxypropyl cellulose acetate phthalate and hydroxyethylcarboxymethyl cellulose, etc.), starch and derivatives thereof (starch, α-starch, carboxymethyl starch, hydroxypropyl starch and dialdehyde starch, etc.), dextran, dextran sodium sulfate, pullulan, Xanthan gum, devil's tongue mannan, karaya gum, gum ghatti, gum tragacanth, etc.; and examples of natural proteins and derivatives thereof include gelatin, phthalated gelatin, gluten, casein, albumin, glue, etc. Examples of synthetic hydrophilic polymers include polyvinyl alcohol, polyvinyl methyl ether, polyvinylpyrrolidone, polyvinylacetamide, salts (sodium, potassium or quaternary ammonium salt, etc.) of polyvinylsulfonic acid, salts of polyacrylic acid, polyacrylamide, poly-N-methyl acrylamide, poly-hydroxyalkyl acrylate (and methacrylate) (for example, poly-2-hydroxyethyl acrylate and poly-2-hydroxyethyl methacrylate, etc.), sodium polyglutamine, sodium polystyrenesulfonate, polyvinylbenzyl trimethylammonium chloride, etc., and copolymers thereof (for example, acrylamide-sodium acrylate copolymer, acrylamide-N,N-dimethylacrylamide copolymer, acrylamide-N-methoxymethylacrylamide copolymer, acrylamide-2-hydroxyethyl methacrylate copolymer, 2-hydroxyethyl acrylate-2-hydroxyethyl methacrylate copolymer, methyl vinyl ether-sodium maleate copolymer, styrene-sodium maleamate copolymer, vinyl acetate-vinyl alcohol copolymer, vinyl acetate-sodium maleate copolymer, vinylpyrrolidone-acrylamide copolymer, etc.). They may be used in combination if desired.

Alkali permeability is an important characteristic of the hydrophilic polymers used in the present invention, but it is particularly preferred that although being permeable, the hydrophilic polymer should also have suitable resistance to the aqueous alkali solution. Namely, in carrying out image processing by spreading a photographic processing composition between the image receiving element of the present invention and an exposed light-sensitive material, a part of the first alkali impermeable polymer layer is hydrolyzed by alkali permeating through the hydrophilic polymer layer before conclusion of formation of silver images, when alkali permeability of the hydrophilic polymer layer is great. At the same time, a chemical which has the property of enhancing image stability of the formed silver images also has a property of causing obstruction of development, if it is present in case of formation of silver images, and is incorporated in the hydrolyzable first alkali impermeable polymer layer becomes soluble by the alkali and diffuses into the second layer to have a bad influence upon formation of silver images. Accordingly, chemicals having a property of enhancing the image stability of silver images, but also having a property of obstruction of development, which were difficult to use hitherto, can be advantageously used when the hydrophilic polymer layer causing delay of alkali permeation of the present invention is used.

As a solvent used for applying the hydrophilic polymer layer of the present invention, water is used. If desired, water soluble organic solvents such as alcohols (e.g., methanol, ethanol, propanol and ethylene glycol, etc.), acetone, acetonitrile, dioxane, formamide, tetrahydrofuran, etc., may be used in mixture with water.

In order to apply the hydrophilic polymer layer of the present invention, it is preferred to use coating aids. As such coating aids, those described, for example, in *Product Licensing Index,* Vol. 92, (1971), page 108, paragraph entitled "Coating aids" are used.

Further, various additives can be incorporated in the hydrophilic polymer layer of the present invention if desired. For example, preservatives (glycerine, ethylene glycol, diethylene glycol, triethylene glycol, trimethylolpropane, pentaerythritol or triacetin, etc.), fluorescent whitening agents, antistatic agents, plasticizers, etc., can be incorporated.

The thickness of the hydrophilic polymer layer used between the first alkali impermeable polymer layer and the second alkali impermeable polymer layer in the present invention is not particularly restricted, but it is preferably applied in a range of from 0.05 to 20 $g/m^2$, and more preferably from 0.05 to 5 $g/m^2$, corresponding to degree of controlling diffusion of chemicals serving for formation or improvement of silver transfer images or water resistance of the photographic image receiving element, etc.

The amount of the compounds represented by formulae (I) and (II) added to the layer I varies according to the particular compounds, but it is generally in a range of from about $10^{-6}$ to $10^{-2}$ mols/m$^2$, and preferably the amount is in a range of from $10^{-4}$ to $5\times10^{-3}$ mols/m$^2$.

In carrying out application of the first and the second alkali impermeable polymer layers, substantially organic solvents are used, but they may contain a small amount of water.

As the organic solvents, those conventionally known are used. Two or more kinds of solvent can be used in combination. Suitable organic solvents include alcohols, for example, methanol, ethanol, propanol, ethylene glycol, diethylene glycol, glycerine, etc.; ketones, for example, acetone, methyl ethyl ketone, cyclohexanone, etc.; esters, for example, methyl acetate, ethyl acetate, ethyl formate, methyl butyrate, etc.; halogenated hydrocarbons, for example, methylene chloride, dichloroethane, dichloroethylene, trichloroethane, chloroform, etc.; ethers, for example, diethyl ether, tetrahydrofuran, dioxane, etc.; amides, for example, formamide, dimethylformamide, etc.; hydrocarbons, for example, pentane, hexane, heptane, cyclohexane, etc.; and aromatic hydrocarbons, for example, benzene, toluene, xylene, chlorobenzene, etc.

Examples of polymers that can be used for the first and the second hydrolyzable alkali-impermeable polymers used in the present invention, include, for example, cellulose esters such as cellulose triacetate, cellulose diacetate, cellulose propionate, cellulose acetate butyrate, etc.; and polyvinyl esters such as polyvinyl acetate, polyvinyl propionate, polyvinyl chloroacetate, etc. The alkali impermeable polymer layer composed of at least one of these polymers can be hydrolyzed with the alkali solution so that it becomes alkali permeable. Further, in the second alkali impermeable polymer layer, polyvinyl acetals such as polyvinyl formal, polyvinyl acetal, polyvinyl butyral, etc., can be used, too. In such case, it becomes alkali permeable by acid hydrolysis.

Of the first and the second hydrolyzable alkali impermeable polymer layers used in the present invention, at least a part of the second alkali impermeable polymer layer is necessarily required to have alkali permeability before using for the photographic image receiving element for silver salt diffusion transfer process. Further, in order to improve adhesion to the hydrophilic polymer layer provided between the first hydrolyzable alkali impermeable polymer layer and the second hydrolyzable alkali impermeable polymer layer, a part of the first alkali impermeable polymer layer may be made so as to have alkali permeability.

In order to carry out alkali hydrolysis of the alkali impermeable polymer layer so as to be alkali permeable, a saponifying solution prepared by dissolving alkali such as sodium hydroxide, potassium hydroxide, lithium hydroxide, or tetraalkylammonium hydroxide, etc. in an aqueous alcohol solution containing alcohol such as methanol or ethanol, etc., in an amount of from 10% to 90% by volume is brought in contact with the cellulose ester layer. In order to make contact, any known means of making contact, such as brush coating, roll coating, air knife coating, spray coating of the saponifying solution, immersion in the saponifying solution, etc., can be utilized. Thus, the surface of the cellulose ester layer is saponified by maintaining contact with the saponifying solution.

The saponified layer is alkali permeable, whereby the diffusion transfer processing solution can permeate through it. Since the saponified layer becomes the image receiving layer, the thickness of the image receiving layer can be controlled by factors which have an influence upon thickness of the layer to be saponified, such as concentration of alkali, concentration of alcohol, time of action of the saponifying bath, temperature, etc. For example, in the case of a cellulose ester layer, the thickness of the image receiving layer is preferred to be in a range of from 0.1 to 20$\mu$, and more preferably is from 0.5 to 10$\mu$. If the thickness of the image receiving layer is too thin, sufficient transfer density is difficult to obtain. If it is too thick, a large amount of the processing solution permeates in the image receiving layer, causing contamination of the image receiving sheet by oxidation of the developing agent, or causing deterioration of image stability of the silver images.

The second alkali impermeable polymer layer preferably contains a silver precipitation nucleus substance. The silver precipitation nucleus substance can be incorporated in the second alkali impermeable polymer layer before or after the layer becomes alkali permeable, or simultaneously with chemical processing for providing alkali permeability. Such processes are well known to skilled in the art. For example, the silver precipitation nucleus substance can be incorporated by processes described in Japanese Patent Publication No. 32754/69, Japanese Patent Application (OPI) No. 120634/74, Japanese Patent Publication No. 49411/76, U.S. Pat. No. 3,179,517, etc.

As silver precipitation nucleus substances, all substances known hitherto as silver precipitation nuclei can be used, examples of which include heavy metals such as zinc, mercury, lead, cadmium, iron, chromium, nickel, tin, cobalt, copper, etc., noble metals such as palladium, platinum, silver, gold, etc., sulfides, selenides, and tellurides of these metals, etc. These silver precipitation nucleus substances are obtained by reducing corresponding metal ion to produce a metal colloid dispersion or by mixing a solution of metal ion with a solution of soluble sulfide, selenide, or telluride to produce a colloid dispersion of water insoluble metal sulfide, metal selenide, or metal telluride.

The function of materials such as silver precipitation nuclei in the silver transfer process has been described, for example, in U.S. Pat. No. 2,774,667 published on Dec. 18, 1956. In order to obtain image receiving elements which provide images having a suitable tone, silver precipitation nuclei are generally incorporated in the image receiving layer in an amount of from $10^{-10}$ to $10^{-5}$ g/m$^2$, and preferably from $10^{-8}$ to $10^{-6}$ g/cm$^2$.

In the photographic image receiving element for the silver salt diffusion transfer process of the present invention, the image receiving layer containing silver precipitation nuclei preferably contains a toning agent. "Toning agent" as used herein refers to a compound capable of changing the color tone of silver transfer images formed after photographic processing.

Examples of useful toning agent include imidazolidine-2-tione, perhydrodiazine-2-thione, benzimidazoles (for example, benzimidazole, 2-mercaptobenzimidazole, 2-mercapto-5-methylbenzimidazole and 2-mercapto-5-chlorobenzimidazole, etc.), mercaptoimidazoles (for example, 2-mercaptoimidazole, 2-mercapto-4-phenylimidazole, 1-methyl-2-mercapto-5-phenylimidazole, 1-benzyl-2-mercaptoimidazole and 2-mercapto-1-phenylimidazole, etc.), mercaptotriazoles (for example, 3-mercapto-4,5-dimethyltriazole and 4-p-tolyl-4H-1,2,4-triazole-3-thiol, etc.), benzotriazoles (for example, benzotriazole-2-thiol, etc.), tetrazole-5-thiols (for example, 1-phenyl-5-mercaptotetrazole and 1-ethyl-5-mercapto-1H-tetrazole, etc.), mercaptopyrimidines (for example, 2-mercaptopyrimidine, 2,4-dimercaptopyrimidine and 4-hydroxy-2,6-dimercaptopyrimidine, etc.) and tetrazapentalenes (for example, 1,4-dimercapto-3H,6H-2,3a,5,6a-tetrazapentalene and 3,6-diphenyl-1,4-dimercapto-3H,6H-2,3a,5,6a-tetrazapentalene, etc.). In addition, compounds described in Andre Rott, Dipl Ing, and Edith Weyde, Dr. Ing, *Photographic Silver Halide Diffusion Processes,* Chapter 3,2,4,4, pages 61–65, U.S. Pat. No. 3,756,825, German Pat. No. 1,903,741, British Pat. No. 1,230,470, and French Pat. No. 2,090,476 can be effectively used.

The amount of the toning agent used used varies according to the kind of compound, but it is generally in a range of from about $10^{-9}$ to $10^{-4}$ mols/m$^2$, and preferably from $10^{-7}$ to $10^{-5}$ mols/m$^2$, since the color tone of silver transfer images becomes reddish black when the amount is too small, or the color tone becomes gray or the optical density is generally reduced when the amount is too large.

Of the above described toning agents, benzimidazoles, mercaptoimidazoles, and mercaptopyrimidines are preferred.

The thickness of the layer I and the thickness of the layer II are generally from 0.1 to 20μ and from 0.1 to 10μ, respectively, and preferably from 0.5 to 10μ and from 0.5 to 5μ, respectively. If the thickness of the layer I and the layer II are too thin, the function of each layer is not be sufficiently exhibited. On the other hand, if the above described layers are too thick, excess development processing solution remains in the films of layer I and layer II, to thereby cause staining and deterioration of the image stability of the images.

The image receiving element of the present invention is preferably supported on a base. Examples of useful bases include paper, baryta paper, pigment coated paper such as titanium white coated paper, etc., coated paper obtained by applying high polymers such as cellulose acetate, cellulose nitrate, polyvinyl butyral, polyvinyl formal, cellulose butyrate, cellulose acetate butyrate, cellulose propionate, polyethylene, polystyrene, etc., by a lacquer coating method, emulsion coating method, etc., and films of high polymers such as polyethylene terephthalate, cellulose diacetate, cellulose triacetate, nitrocellulose, polycarbonate, polyvinyl chloride, etc., and all bases used hitherto in the photographic field can be used.

If desired, an alkali neutralizing agent layer may be provided. In the alkali neutralizing agent layer, polymer acids described, for example, in Japanese Patent Publication No. 33697/73 are used. The alkali neutralizing layer is preferred to be provided between the first alkali impermeable polymer layer and the base for supporting it. As preferred polymer acids, there are maleic acid anhydride copolymers, for example, styrene-maleic acid anhydride copolymer, methyl vinyl ether-maleic acid anhydride copolymer and ethylene-maleic acid anhydride copolymer, etc., and acrylic (methacrylic) acid polymers (copolymers), for example, acrylic acid-alkyl acrylate copolymer, acrylic acid-alkyl methacrylate copolymer, methacrylic acid-alkyl acrylate copolymer and methacrylic acid-alkyl methacrylate copolymer, etc. Further, in the image receiving material of the present invention, a thin layer composed of alkali permeable or alkali soluble polymer materials called separating layer can be provided on the surface of the layer II similarly to the prior image receiving elements.

In a gelatin-silver halide light-sensitive element used in the present invention, emulsions of silver chloride, silver bromide, silver iodide, silver chlorobromide, silver iodobromide and silver chloroiodobromide can be used, with silver bromide and silver iodobromide being preferably used. The average particle size of these silver halides is generally in a range of from 0.1 to 10μ. If desired, optical sensitizers, chemical sensitizers, antifoggants, gelatine hardeners and surface active agents, etc., can be added. In certain cases, a developing agent for development processing may be incorporated in the silver halide light-sensitive element.

It has been understood that hydroxylamine silver halide developing agents are particularly useful for forming silver transfer images with little or no need for post-processing when they are used in combination with a regenerated cellulose silver image receiving layer. Particularly useful hydroxylamine silver halide developing agents include N-alkyl and N-alkoxyalkyl substituted hydroxylamines. Many of such hydroxylamine have been described in U.S. Pat. Nos. 2,857,274, 2,857,275, 2,857,276, 3,287,124, 3,287,125, 3,293,034, 3,362,961 and 3,740,221. Particularly effective and suitable hydroxylamine silver halide developing agents can be represented by the formula:

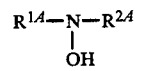

(wherein $R^{1A}$ represents alkyl, alkoxyalkyl or alkoxyalkoxyalkyl, and $R^{2A}$ represents hydrogen, alkyl, alkoxyalkyl, alkoxyalkoxyalkyl or alkenyl). Preferably, the alkyl, alkoxy, and alkenyl groups contain from 1 to 3 carbon atoms. Examples of particularly useful hydroxylamine silver halide developing agents include N,N-diethyl-hydroxylamine, N,N-bis-methoxyethyl-hydroxylamine, and N,N-bis-ethoxyethylhydroxylamine.

Further, dihydroxybenzene compounds (for example, hydroquinone, t-butylhydroquinone, methylhydroquinone, etc.), reductone compounds described in U.S. Pat. Nos. 3,672,896 4,128,425 and reductone compounds described in U.S. Pat. No. 3,615,440 are useful as silver halide developing agents.

Further, phenidone compounds, p-aminophenol compounds, and ascorbic acid can be used as auxiliary developing agents together with the above described developing agents.

The silver halide solvent may be alkali metal thiosulfates such as sodium thiosulfate or potassium thiosulfate, and preferably are cyclic imides such as uracil, urazol, 5-methyl-uracil, etc. as described, e.g., in U.S. Pat. Nos. 3,857,274, 3,857,275 and 3,857,276.

The processing composition contains alkalies, preferably alkali metal hydroxide, such as sodium hydroxide or potassium hydroxide. When the processing composition is distributed as a thin layer between the light-sensitive element and the image receiving element placed in layers, and particularly when it is distributed such that these elements are in a superposed relation, the processing composition preferably contains polymer film-forming agents, thickening agents, or viscosity increasing agents. Hydroxyethyl cellulose and sodium carboxymethyl cellulose are particularly useful for such a purpose, and they are incorporated in the processing composition so as to have a concentration effective to provide a suitable viscosity in accordance with the known principles of the diffusion transfer photographic process. The processing composition may further contain other assistants known in the silver transfer process, for example, antifoggants, toning agents, stabilizers, etc. As the antifoggants and the toning agents, mercapto compounds, imidazole compounds, indazole compounds, triazole compounds, etc. are useful, and compounds as described in U.S. Pat. Nos. 3,565,619, 3,642,473, 3,756,825, British Pat. No. 1,122,158, German Patent Application (OLS) No. 1,804,365, etc., are particularly effective. It has been found that if oxyethylamino compounds, for example, triethanolamine, are incorporated as stabilizers, the storage life of the processing composition is increased as described in U.S. Pat. No. 3,619,185.

The image receiving elements obtained by the present invention can be used in various forms. One of them is that known as peel-apart type diffusion transfer light-sensitive materials, wherein an image receiving material sheet and a light-sensitive material sheet are separated as separate sheets, and the image receiving material is folded or rolled up so as not to prevent exposure of the light-sensitive material in the stage of exposure. After exposed to light, the light-sensitive material and the image receiving material are laid in a superposed state, and processing is carried out by spreading the development processing solution between them. After processing for a denifite time, the image receiving material is separated from the light-sensitive material to obtain positive images on the image receiving material.

On the other hand, in the form known as integrated negative and positive type diffusion transfer light-sensitive materials, the image receiving material and the light-sensitive material are joined together in a body to form, apparently, one sheet. In this case, when exposure is carried out through the image receiving material, which is light permeable to a degree of not preventing exposure of the light-sensitive material, or the image is observed through the base, which is light permeable, of the light-sensitive material, only a positive image is visible, because the negative image is interrupted by a light reflecting material layer of the processing solution. Therefore, in such diffusion transfer photographic materials, positive images can be observed after image formation without separating the image receiving material from the light-sensitive material.

As such integrated negative and positive diffusion transfer light-sensitive materials, those having various layer constructions have been known in addition to the above described photographic materials. The image receiving elements of the present invention which are improved in order to obtain silver images having high stability can be applied to every case regardless of the difference of layer construction.

When the photographic image receiving elements for silver salt diffusion transfer process of the present invention are used, effects obtained include (1) that lowering of optical density of silver images in the case of image processing is very small even if the element is stored for a long period of time before the image processing, and (2) that discoloration and lowering of optical density of the resulting silver images hardly occur during preservation after image processing.

Further, it is among the characteristics of the present invention that when the hydrophilic polymer layer is used, the use of various kinds of organic solvent soluble chemicals to be incorporated in the first alkali impermeable polymer layer is facilitated, and the use of various kinds of silver precipitation nuclei to be incorporated in the second image receiving layer is also facilitated.

The present invention is distinctly different from Japanese Patent Publication No. 44418/81, e.g., in the following characteristics of the present invention.

(1) INTERMEDIATE LAYER COMPOSED OF HYDROPHILIC POLYMER

This is provided between the first layer containing an image stabilizer and the second layer containing silver precipitation nuclei and it neither dissolved nor swells in organic solvents used for applying these layers, and thus forms distinct interfaces between these layers and prevents unnecessary movement of the image stabilizer before production of the image receiving sheet or before use by users. Further, it has resistance to permeation of the alkali solution and prevent hydrolysis of the second layer when the second layer is subjected to hydrolysis. Further, it prevents diffusion of the image stabilizer in the second layer when subjected to development processing and it has an effect of slowly diffusing in the first layer during preservation of images after conclusion of the development processing.

(2) IMAGE STABILIZER

As a result of searching for various kinds of mercapto substituted compound as image stabilizers, it has been found that the compounds of the present invention are particularly effective. They are more hydrophobic than known 1-phenyl-5-mercaptotetrazole, imidazolidinethione, etc., and have an advantage that unnecessary movement is more effectively prevented in the intermediate layer composed of hydrophilic polymer. The image stabilizer slowly diffuses in the second layer after conclusion of the diffusion transfer processing and is adsorbed on the developed images to prevent discoloration and fading thereof.

(3) TONING AGENT

A toning agent in an amount necessary to suitably control the color tone of development silver is previously added to the image receiving layer containing silver precipitation nuclei or added to the processing solution. Accordingly, an effective concentration of the toning agent in the image receiving layer in which transfer silver is formed as kept constant during the diffusion transfer processing.

As described above, when image receiving materials having a novel construction according to the present invention are used:

(i) image receiving materials containing a larqe quantity of of the image stabilizer are obtained, which materials can be very stably preserved in the process for production or before use by users, and the materials exhibit improved discoloration and fading properties of the resulting images during storage after image formation, and (ii) images having constant quality can always be obtained, because the toning agent is always sufficiently kept in the layer where development is carried out during development processing.

Some preferred embodiments according to the present invention are as follows:

1. A photographic image receiving element for a silver salt diffusion transfer process as described above in the Summary, wherein the image receiving layer contains a toning agent.

2. A photographic image receiving element for a silver salt diffusion transfer process according to above Embodiment 1, wherein said toning agent is at least one compound selected from a benzimidazole, a mercaptoimidazole, and a mercaptopyrimidine.

3. A photographic image receiving element for a silver salt diffusion transfer process as described above in the Summary, wherein the hydrolyzable first and second alkali impermeable polymer layers comprise acetyl cellulose.

4. A photographic image receiving element for a silver salt diffusion transfer process as described above in the Summary, wherein the silver precipitation nuclei are metal colloids of gold, silver, platinum, or palladium, or sulfides of nickel, silver, lead, platinum, or palladium.

5. A photographic image receiving element for a silver salt diffusion transfer process as described above in the Summary, wherein a layer containing polymer acid is provided between the first alkali impermeable polymer layer and the base.

6. A photographic image receiving element for a silver salt diffusion transfer process according to above Embodiment 5, wherein the layer containing polymer acid contains an acrylic acid or methacrylic acid polymer or copolymer, maleic acid anhydride copolymer, or a mixture of said polymer or copolymer and cellulose acetate.

In the following, the present invention is illustrated with reference to examples, but the present invention is not intended to be limited to these examples.

EXAMPLE 1

(Production of Image Receiving Element I)

To the surface of baryta paper (120 g/m$^2$, thickness: 0.140 mm), a solution of cellulose acetate (degree of acetylation: 54%) dissolving 0.1 g of 1-(4-N-butylcarbamoylphenyl)-2-mercaptoimidazole in acetone was applied so as to result in a dry coating amount of 5 g/m$^2$. To the resulting layer, an aqueous solution of gum arabic was applied so as to result in a dry coating amount of 0.7 g/m$^2$. Further, to the resulting layer, a solution of cellulose acetate in acetone was applied so as to result in a dry film thickness of 1.3 $\mu$m. To the above described coated material, an alkali solution containing nickel sulfide as silver precipitation nuclei was applied so as to result in a thickness of 25 ml/m$^2$ and dried. It was then washed with water and dried to produce image receiving element I. Formulation of the alkali solution used was as follows:

NaOH: 20 g
$H_2O$: 200 ml
Methanol: 800 ml
Glycerine: 30 g
NiS: 0.06 g

Nickel sulfide contained in the above described alkali solution was prepared by reacting a 20% aqueous solution of nickel nitrate with a 20% aqueous solution of sodium sulfide in glycerine with stirring.

EXAMPLE 2

(Production of Image Receiving Element II)

To polyethylene laminated paper, a solution of 18 g of cellulose acetate (degree of acetylation: 55%) and 12 g of methyl vinyl ether-maleic acid anhydride copolymer in a mixture of 270 ml of acetone and 30 ml of methanol was applied so as to result in a thickness of 70 ml/m$^2$ and dried. To the resulting coated material, a solution containing 0.299% of 3,6-dibutyl-1,4-dimercapto-3H,6H-2,3a,5,6a-tetrazapentalene in cellulose acetate-acetone was applied so as to result in a dry film thickness of 50 mg/(dm)$^2$. To the resulting layer, a solution prepared by adding 1 ml of formalin to a 4% aqueous solution of gum arabic was applied so as to result in a dry film thickness of 0.5 g/m$^2$ and dried. Further, to the resulting layer, a solution of cellulose acetate in acetone was applied so as to result in a dry film thickness of 0.016 g/(dm)$^2$. An alkali solution containing nickel sulfide was applied so as to result in a thickness of 20 ml/m$^2$ and dried by the same manner as in Example 1. It was then washed with water and dried. Further, a solution containing $5\times10^{-4}$% by weight of 1-phenyl-5-mercaptoimidazole in methanol was applied so as to result in 22 ml/m$^2$, and dried to produce image receiving element II.

EXAMPLE 3

Image receiving element III was produced in the same manner as in Example 1 except that arabic acid was used so as to result in a dry film thickness of 0.8 g/m$^2$, instead of using gum arabic as in Example 1.

EXAMPLE 4

Image receiving element IV was produced in the same manner as in Example 2, except that arabic acid was used so as to result in a dry film thickness of 0.6 g/m$^2$ instead of using gum arabic as in Example 2.

EXAMPLE 5

(Production of Image Receiving Element V)

To polyethylene laminated paper, a solution prepared by dissolving 18 g of cellulose acetate (degree of acetylation: 54%) and 12 g of styrene-maleic acid anhydride copolymer in a mixture of 270 ml of acetone and 30 ml of methanol was applied so as to result in a thickness of 54 ml/m$^2$, and dried. To the resulting layer, a solution containing 0.62% of 3,6-dibutyl-1,4-dimercapto-3H,6H-2,3a,5,6a-tetrazapentalene in cellulose acetate-acetone was applied so as to result in a dry film thickness of 6 g/m$^2$. Further, to the resulting layer, a 5% aqueous solution of gum arabic to which an aqueous solution of formaldehyde (10%) and glycerine were added in amounts of 5% and 7% by weight based on a weight of gum arabic, respectively, was applied so as to result in a thickness of 25 ml/m$^2$. Further, to the resulting layer, a solution of cellulose acetate in acetone/methanol in which palladium sulfide was finely dispersed was applied. In this coating solution, 2-mercaptobenzimidazole was incorporated in such an amount that the coated amount was $1.5\times10^{-6}$ mols/m$^2$. The dry film thickness was 1.4 $\mu$m. To the resulting coated material, the following alkali solution was applied in an amount of 18 ml/m$^2$, and it was washed with water and dried to produce image receiving element V. The above described palladium sulfide dispersion was prepared by adding a solution of $7\times10^{-3}$ mols of sodium sulfide in methanol and a solution of $7\times10^{-3}$ mols of sodium palladium chloride in methanol to a 5.3% solution of cellulose acetate in acetone/methanol mixture and thoroughly stirring the mixture.

Production of Comparative Image Receiving Element A

Comparative image receiving element A was produced in the same manner as in Example 1, except that 1-phenyl-5-mercaptotetrazole was used instead of 1-(4-N-butylcarbamoylphenyl)-2-mercaptoimidazole as in Example 1.

Production of Comparative Image Receiving Element B

Comparative image receiving element B was produced in the same manner as in Example 2, except that 1-phenyl-5-mercaptotetrazole was used instead of 3,6-dibutyl-1,4-dimercapto-3H,6H-2,3a,5,6a-tetrazapentalene as in Example 2.

Production of Comparative Image Receiving Element C

Comparative image receiving element C was produced in the same manner as in Example 5, except that 1-phenyl-5-mercaptotetrazole was used instead of 3,6-dibutyl-1,4-dimercapto-3H,6H-2,3a,5,6a-tetrazapentalene as in Example 5.

Production of Comparative Image Receiving Element D

Comparative image receiving element D was produced in the same manner as in Example 2, except that application of the aqueous solution of gum arabic as in Example 2 was omitted.

Production of Comparative Image Receiving Element E

Comparative image receiving element E was produced in the same manner as in Example 5, except that application of the aqueous solution of gum arabic in Example 5 was omitted.

EXAMPLE 6

Using image receiving elements I–V and comparative image receiving elements A, B, and C, the following light-sensitive layer sheet and the following processing solution, diffusion transfer development processing was carried out to obtain positive images.

(1) Preparation of Light-Sensitive Layer Sheet

Silver iodobromide having an average particle size of 1.0 μm was prepared by the conventional method, and it was put in a 100 g pot and dissolved at 50° C. in a constant temperature bath. To it, 10 ml of a 1 wt% aqueous solution of 3-(5-chloro-2-(2-ethyl-3-(3-ethyl-2-benzothiazolinylidene)propenyl)-3-benzoxazolo)propanesulfonate, 4-{2-[(3-ethylbenzothiazoline-2-ylidene)-2-methyl-1-propenyl]-3-benzothiazolo}butane sulfonate and 4-hydroxy-6-methyl-1,3,3a,7-tetrazaindene, 10 ml of a 1 wt% aqueous solution of 2-hydroxy-4,6-dichlorotriazine sodium salt, and 10 ml of a 1 wt% aqueous solution of sodium dodecylbenzenesulfonate were added, and the mixture was stirred. The resulting emulsion was applied to a polyethylene terephthalate film base undercoated by a subbing coating containing titanium oxide, so as to result in a dry film thickness of 5 microns and dried to obtain a sample. The amount of coated silver was 1.0 g/m$^2$.

(2) Formulation of Processing Solution

Potassium hydroxide (40% aqueous solution of KOH): 323 cc
Titanium dioxide: 3 g
Hydroxyethyl cellulose: 79 g
Zinc oxide: 9.75 g
N,N-bis-methoxyethylhydroxyamine: 75 g
Triethanolamine solution (4.5 parts of triethanolamine based on 6.2 parts of water): 17.14 g
Tetrahydropyrimidinethione: 0.4 g
2,4-Dimercaptopyrimidine: 0.35 g
Uracil: 80 g
Water: 1193 g The light-sensitive layer sheet was exposed to a light wedge by means of a sensitometer having a light source of a color temperature of 5400° K. The exposed light-sensitive layer sheet and the above described image receiving layer sheet were laid in layers, and the above described processing solution was spread between both layers so as to have a thickness of 0.05 mm in order to carry out diffusion transfer development. After being allowed to stand at 25° C. for 45 seconds, both sheets were separated to obtain positive images.

It was measured by a TCD type self-recording densitometer produced by Fuji Photo Film Co., to determine maximum density.

| Image receiving element | I | II | III | IV | V |
|---|---|---|---|---|---|
| Maximum density | 1.7 | 1.6 | 1.75 | 1.65 | 1.72 |
| Comparative image receiving element | A | B | C | D | E |
| Maximum density | 0.8 | 1.0 | 1.2 | 1.0 | 1.1 |

As is obvious from the above results, higher maximum optical density was obtained in case of using image receiving elements of the present invention as compared with the corresponding comparative image receiving elements.

EXAMPLE 7

Image receiving elements I–V and comparative image receiving elements A–E were subjected to an accelerated deterioration test at a relative humidity of 80% and a temperature of 50° C. for 3 days before diffusion transfer processing as in Example 6, and they were subjected to diffusion transfer processing by the same manner as in Example 5 to obtain positive images.

| Image receiving element | I | II | III | IV | V |
|---|---|---|---|---|---|
| Maximum density | 1.53 | 1.45 | 1.55 | 1.4 | 1.48 |
| Comparative image receiving element | A | B | C | D | E |
| Maximum density | 0.6 | 0.9 | 1.1 | 0.9 | 0.85 |

It is understood from the above described results that the maximum density after the above described accelerated deterioration test is remarkably high in case of using image receiving elements of the present invention as compared with the corresponding comparative image receiving elements.

EXAMPLE 8

Images obtained in Example 6 were subjected to an accelerated deterioration test at a temperature of 60° C. and a relative humidity of 70% for 3 days.

| Image receiving element | I | II | III | IV | V |
|---|---|---|---|---|---|
| Maximum density | 1.54 | 1.55 | 1.6 | 1.58 | 1.64 |
| Lowering of density by deterioration test | 0.16 | 0.05 | 0.15 | 0.07 | 0.08 |
| Comparative image receiving element | A | B | C | D | E |
| Maximum density | 0.6 | 0.75 | 1.0 | 0.82 | 0.88 |
| Lowering of density by deterioration test | 0.2 | 0.25 | 0.2 | 0.18 | 0.22 |

It is understood from the above described results that maximum density of the images obtained after the accelerated deterioration test is evidently high in the image receiving elements of the present invention, the degree of lowering of density by the accelerated deterioration is small, and thus the images have high stability.

While the invention has been described in detail and with reference to specific embodiments thereof, it will be apparent to one skilled in the art that various changes and modifications can be made therein without departing from the spirit and scope thereof.

What is claimed is:

1. In a photographic image receiving element for a silver salt diffusion transfer process which comprises a hydrolyzable first alkali impermeable polymer layer applied on a base and an image receiving layer thereon comprising a hydrolyzable second alkali impermeable polymer layer containing silver precipitation nuclei which is prepared by hydrolyzing at least a part of the hydrolyzable second alkali impermeable polymer layer so as to be alkali permeable, the improvement wherein at least one hydrophilic polymer layer containing at least one of gum arabic and arabic acid is coated between said first alkali impermeable polymer layer and said image receiving layer, and said first alkali impermeable polymer layer contains at least one compound represented by formula (I) or formula (II)

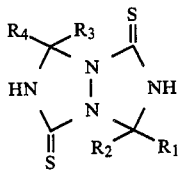

(I)

wherein $R_1$, $R_2$, $R_3$ and $R_4$ each represents a hydrogen atom, an alkyl group having from 1 to 8 carbon atoms, or an aryl group having from 6 to 12 carbon atoms,

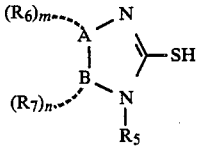

(II)

wherein A and B each represents a nitrogen atom or a carbon atom, provided that A and B are not both nitrogen atoms, m is 0 and A is a nitrogen atom, n is 0 when B is a nitrogen atom, and m and n are 1 when A and B are each a carbon atom, $R_5$, $R_6$ and $R_7$ each represents a hydrogen atom, an alkyl group having from 1 to 10 carbon atoms or a substituted or nonsubstituted aryl group having from 6 to 20 carbon atoms, and $R_6$ and $R_7$ together can additionally represent a substituted or unsubstituted aromatic carbocyclic ring together with A and B.

2. A photographic image receiving element as in claim 1, wherein the image receiving layer contains a toning agent.

3. A photographic image receiving element for a silver salt diffusion transfer process according to claim 2, wherein said toning agent is at least one compound selected from a benzimidazole, a mercaptoimidazole, and a mercaptopyrimidine.

4. A photographic image receiving element for a silver salt diffusion transfer process according to claim 1, wherein the hydrolyzable first and second alkali impermeable polymer layers comprise acetyl cellulose.

5. A photographic image receiving element for a silver salt diffusion transfer process according to claim 1, wherein the silver precipitation nuclei are metal colloids of gold, silver, platinum, or palladium, or sulfides of nickel, silver, lead, platinum, or palladium.

6. A photographic image receiving element for a silver salt diffusion transfer process according to claim 1, wherein a layer containing a polymeric acid is provided between the first alkali impermeable polymer layer and the base.

7. A photographic image receiving element for a silver salt diffusion transfer process according to claim 6, wherein the polymeric acid comprises an acrylic acid or methacrylic acid polymer or copolymer, maleic acid anhydride copolymer, or a mixture of said polymer or copolymer and cellulose acetate.

8. A photographic image receiving element for a silver salt diffusion transfer process according to claim 1, wherein $R_5$ is an alkyl group or an aryl group.

9. A photographic image receiving element for a silver salt diffusion transfer process according to claim 1, wherein $R_6$ and $R_7$ together represent a substituted and non-substituted six-membered aromatic carbocyclic ring.

10. A photographic image receiving element for a silver salt diffusion transfer process according to claim 1, wherein the hydrophilic polymer layer contains less than 30% by weight of hydrophilic polymer other than gum arabic and arabic acid.

11. A photographic image receiving element for a silver salt diffusion transfer process according to claim 1, wherein the hydrophilic polymer layer contains less than 20% by weight of hydrophilic polymers other than gum arabic and arabic acid.

12. A photographic image receiving element for a silver salt diffusion transfer process according to claim 1, wherein the thickness of the hydrophilic polymer layer is from 0.05 to 20 g/m$^2$.

13. A photographic image receiving element for a silver salt diffusion transfer process according to claim 1, wherein the thickness of the hydrophilic polymer layer is from 0.05 to 5 g/m$^2$.

14. A photographic image receiving element for a silver salt diffusion transfer process according to claim 1, wherein the amount of the compounds represented by formulae (I) and (II) is from about $10^{-6}$ to $10^{-2}$ mols/m$^2$.

15. A photographic image receiving element for a silver salt diffusion transfer process according to claim 1, wherein the amount of the compounds represented by formulae (I) and (II) is from about $10^{-4}$ to $5\times10^{-3}$ mols/m$^2$.

* * * * *